US007708342B2

(12) United States Patent
Leach

(10) Patent No.: US 7,708,342 B2
(45) Date of Patent: May 4, 2010

(54) NON-SLIP BODY-CONFORMING BOOSTER CUSHION SEAT

(76) Inventor: Jamie S. Leach, 130 E. Tenth St., Ada, OK (US) 74820

( * ) Notice: Subject to any disclaimer, the term of this patent is extended or adjusted under 35 U.S.C. 154(b) by 114 days.

(21) Appl. No.: 11/216,361

(22) Filed: Aug. 31, 2005

(65) Prior Publication Data

US 2007/0046084 A1 Mar. 1, 2007

(51) Int. Cl.
*A47D 1/10* (2006.01)
*A47C 1/08* (2006.01)

(52) U.S. Cl. ..... 297/250.1; 297/256.11; 297/452.17; 297/485; 5/653; 5/655.4

(58) Field of Classification Search ..... 297/250.1, 297/452.17, 219.12, 254, 485, 452.22, 256.11; 5/653, 655.4, 702, 911
See application file for complete search history.

(56) References Cited

U.S. PATENT DOCUMENTS

| | | | | |
|---|---|---|---|---|
| 395,043 | A | 12/1888 | Doremus | |
| 416,970 | A | 12/1889 | Taylor | |
| 726,164 | A | 4/1903 | Hogan et al. | |
| 909,453 | A | 1/1909 | Pullman | |
| 1,376,625 | A | 5/1921 | Johnston | |
| 1,447,288 | A | 3/1923 | Emmerich | |
| 1,577,586 | A | 3/1926 | Morehouse | |
| 1,769,722 | A | 7/1930 | Sutton | |
| 2,149,140 | A | 2/1939 | Gonzalez-Rincones | |
| D124,296 | S | 12/1940 | Thompson | |
| 2,279,867 | A | 4/1942 | Falk | |
| 2,328,871 | A | 9/1943 | Woehler | |
| 2,336,707 | A | 12/1943 | Thompson | |
| 2,404,108 | A | 7/1946 | Stauffacher et al. | |
| 2,404,505 | A | 7/1946 | Knecht | |
| 2,429,350 | A | 10/1947 | Farrand | |
| 2,451,007 | A | 10/1948 | White | |
| 2,495,482 | A | 1/1950 | Rogatz | |
| 2,502,486 | A | 4/1950 | Savrin | |
| 2,544,896 | A * | 3/1951 | Nidetch et al. | 297/250.1 |
| D162,858 | S | 4/1951 | McGlinchey | |
| 2,626,407 | A | 1/1953 | Kurry | |
| 2,652,183 | A | 9/1953 | Hlivka | |

(Continued)

FOREIGN PATENT DOCUMENTS

| | | |
|---|---|---|
| JP | 20041949989 | 7/2004 |

(Continued)

OTHER PUBLICATIONS

Abstract, JP 2004 194989, Jul. 15, 2004, ESPACENET.

*Primary Examiner*—David Dunn
*Assistant Examiner*—Tania Abraham
(74) *Attorney, Agent, or Firm*—Mary M. Lee

(57) ABSTRACT

A body-conforming booster cushion seat having a malleable filler material so as to permit the cushion to conform to the body shape of a user when the user is seated thereon. The booster cushion seat includes a strap for securing the cushion to the chair, and the height of the cushion may be adjusted by adjusting the tension on the strap. The bottom of the cushion is provided with a textured base to prevent slipping when the textured base contacts a corresponding surface, and a safety belt is included to secure a juvenile user in place on the booster cushion seat.

25 Claims, 4 Drawing Sheets

U.S. PATENT DOCUMENTS

| | | | | | |
|---|---|---|---|---|---|
| 2,694,202 | A | | 11/1954 | Macrides | |
| 2,694,204 | A | | 11/1954 | Cross | |
| 2,741,412 | A | | 4/1956 | Hinkle | |
| 2,795,802 | A | | 6/1957 | Myers | |
| 2,817,090 | A | | 12/1957 | Toellner | |
| 2,857,957 | A | | 10/1958 | Gay | |
| 2,880,424 | A | | 4/1959 | Kalensky | |
| D191,513 | S | | 10/1961 | Kerr | |
| 3,088,438 | A | | 5/1963 | Oliphant | |
| D201,492 | S | | 6/1965 | Jacobson | |
| 3,239,271 | A | | 3/1966 | Bergersen | |
| 3,298,035 | A | | 1/1967 | Gobins | |
| 3,327,330 | A | | 6/1967 | McCullough | |
| 3,392,737 | A | | 7/1968 | Fefferman | |
| 3,604,026 | A | | 9/1971 | Scheips | |
| 3,604,750 | A | | 9/1971 | Doering | |
| 3,671,977 | A | | 6/1972 | Degnon | |
| 3,713,692 | A | | 1/1973 | McCracken et al. | |
| D227,423 | S | | 6/1973 | Audo | |
| 3,773,287 | A | | 11/1973 | Hechinger | |
| D230,804 | S | | 3/1974 | Lijewski | |
| 3,840,916 | A | | 10/1974 | Jennings | |
| 3,848,281 | A | | 11/1974 | Matthews | |
| 3,899,210 | A | * | 8/1975 | Samhammer et al. | 297/448.2 |
| 3,899,797 | A | | 8/1975 | Gunst | |
| 3,911,512 | A | | 10/1975 | Plate | |
| D244,569 | S | | 6/1977 | Laroye | |
| 4,027,888 | A | * | 6/1977 | Wilcox | 297/452.17 |
| 4,031,567 | A | | 6/1977 | Planck | |
| 4,037,764 | A | | 7/1977 | Almosnino et al. | |
| 4,050,737 | A | | 9/1977 | Jordan | |
| 4,173,048 | A | | 11/1979 | Varaney | |
| 4,179,158 | A | * | 12/1979 | Flaum et al. | 297/440.17 |
| 4,194,254 | A | | 3/1980 | Torrez | |
| 4,197,604 | A | | 4/1980 | Nakamura | |
| 4,227,270 | A | | 10/1980 | Rivera | |
| 4,235,474 | A | | 11/1980 | Rosenberg | |
| 4,236,264 | A | | 12/1980 | Britzman | |
| D259,902 | S | | 7/1981 | Rock | |
| 4,287,542 | A | | 9/1981 | Okuda | |
| D265,027 | S | | 6/1982 | Meyers | |
| D266,800 | S | | 11/1982 | Kula et al. | |
| 4,383,713 | A | | 5/1983 | Roston | |
| 4,393,530 | A | | 7/1983 | Stark | |
| 4,428,514 | A | | 1/1984 | Elf | |
| 4,434,920 | A | | 3/1984 | Moore | |
| 4,463,984 | A | * | 8/1984 | Molnar | 297/250.1 |
| 4,506,396 | A | | 3/1985 | Ritchie, Jr. et al. | |
| 4,550,459 | A | | 11/1985 | Endel et al. | |
| 4,574,412 | A | | 3/1986 | Smith | |
| D284,220 | S | | 6/1986 | Pote | |
| 4,592,589 | A | | 6/1986 | Hellwig | |
| 4,606,078 | A | | 8/1986 | Tkacsik | |
| 4,606,087 | A | * | 8/1986 | Alivizatos | 5/424 |
| 4,624,021 | A | | 11/1986 | Hofstetter | |
| 4,654,907 | A | | 4/1987 | Haugaard | |
| 4,666,017 | A | | 5/1987 | Zimmerman | |
| 4,667,356 | A | * | 5/1987 | Holmquist | 5/655 |
| 4,667,624 | A | | 5/1987 | Smith | |
| 4,670,923 | A | | 6/1987 | Gabriel et al. | |
| 4,676,198 | A | | 6/1987 | Murray | |
| 4,676,554 | A | | 6/1987 | Harlick et al. | |
| 4,685,163 | A | | 8/1987 | Quillen et al. | |
| 4,697,849 | A | * | 10/1987 | Smith | 297/485 |
| 4,698,862 | A | | 10/1987 | Mairs | |
| 4,709,430 | A | | 12/1987 | Nicoll | |
| 4,712,258 | A | | 12/1987 | Eves | |
| 4,731,890 | A | | 3/1988 | Roberts | |
| 4,754,509 | A | | 7/1988 | Pollard | |
| 4,754,510 | A | | 7/1988 | King | |
| 4,757,925 | A | | 7/1988 | Knittel | |
| 4,763,369 | A | | 8/1988 | Spector | |
| 4,788,726 | A | | 12/1988 | Rafalko | |
| 4,790,035 | A | | 12/1988 | Whyte | |
| 4,794,657 | A | | 1/1989 | Avery | |
| 4,796,315 | A | | 1/1989 | Crew | |
| D299,988 | S | | 2/1989 | Parabita | |
| 4,827,542 | A | | 5/1989 | Kurtenbach | |
| 4,834,459 | A | | 5/1989 | Leach | |
| 4,836,605 | A | * | 6/1989 | Greenwood et al. | 297/250.1 |
| 4,840,144 | A | | 6/1989 | Voorhees et al. | |
| 4,850,144 | A | | 7/1989 | Grisham et al. | |
| 4,853,994 | A | | 8/1989 | Ekstein | |
| 4,861,109 | A | | 8/1989 | Leach | |
| D303,897 | S | | 10/1989 | Phillips | |
| 4,871,210 | A | | 10/1989 | Alexander et al. | |
| 4,901,384 | A | | 2/1990 | Eary | |
| D306,948 | S | | 4/1990 | Zollinger | |
| D308,788 | S | | 6/1990 | Boehm | |
| D309,018 | S | | 7/1990 | Leach | |
| D310,609 | S | | 9/1990 | Burkhardt | |
| D313,141 | S | | 12/1990 | Witter et al. | |
| 4,980,937 | A | | 1/1991 | Mason et al. | |
| 4,986,458 | A | | 1/1991 | Linday | |
| 4,996,734 | A | | 3/1991 | Rowe | |
| 4,999,863 | A | | 3/1991 | Kane | |
| 4,999,866 | A | | 3/1991 | Lindsey | |
| 5,015,037 | A | * | 5/1991 | Giblin et al. | 297/452.1 |
| 5,026,315 | A | | 6/1991 | Chap | |
| D318,202 | S | | 7/1991 | Weber | |
| 5,035,013 | A | | 7/1991 | Bloom | |
| D318,969 | S | | 8/1991 | Byrn | |
| 5,048,136 | A | | 9/1991 | Popitz | |
| 5,088,141 | A | | 2/1992 | Meyer et al. | |
| 5,097,551 | A | | 3/1992 | Smith | |
| 5,103,514 | A | | 4/1992 | Leach | |
| 5,109,557 | A | | 5/1992 | Koy et al. | |
| 5,115,524 | A | | 5/1992 | Antosko | |
| 5,119,767 | A | | 6/1992 | Jimenez | |
| 5,154,649 | A | | 10/1992 | Pender | |
| 5,159,727 | A | | 11/1992 | McCracken | |
| 5,161,260 | A | | 11/1992 | Reynolds | |
| 5,165,130 | A | | 11/1992 | Wendling | |
| 5,178,309 | A | | 1/1993 | Bicheler et al. | |
| 5,179,741 | A | | 1/1993 | Book | |
| D332,865 | S | | 2/1993 | Wilmink | |
| 5,187,309 | A | | 2/1993 | Esch et al. | |
| 5,193,238 | A | | 3/1993 | Clute | |
| 5,216,772 | A | | 6/1993 | Clute | |
| D339,923 | S | | 10/1993 | Clarke | |
| 5,249,308 | A | | 10/1993 | Blume | |
| 5,261,134 | A | | 11/1993 | Matthews | |
| D342,615 | S | | 12/1993 | Asher | |
| 5,269,323 | A | | 12/1993 | Krouskop | |
| 5,272,780 | A | | 12/1993 | Clute | |
| 5,310,245 | A | | 5/1994 | Lyszczasz | |
| 5,325,818 | A | | 7/1994 | Leach | |
| 5,339,472 | A | | 8/1994 | Yin | |
| 5,341,531 | A | | 8/1994 | Straub et al. | |
| 5,346,278 | A | * | 9/1994 | Dehondt | 297/219.1 |
| 5,363,524 | A | * | 11/1994 | Lang | 5/640 |
| 5,365,613 | A | | 11/1994 | Henegan | |
| 5,371,909 | A | | 12/1994 | McCarty | |
| D355,306 | S | | 2/1995 | Moses | |
| 5,429,852 | A | * | 7/1995 | Quinn | 428/71 |
| 5,439,008 | A | | 8/1995 | Bowman | |
| D365,241 | S | | 12/1995 | Braden et al. | |
| 5,473,785 | A | | 12/1995 | Lager et al. | |
| D366,368 | S | | 1/1996 | McCarthy | |
| 5,490,528 | A | | 2/1996 | Day | |
| D369,054 | S | | 4/1996 | Straub et al. | |
| D369,934 | S | | 5/1996 | Straub et al. | |
| 5,519,906 | A | | 5/1996 | Fanto-Chan | |
| D370,585 | S | | 6/1996 | Faithfull | |

5,522,528 A 6/1996 Petricola
5,546,620 A 8/1996 Matthews
5,551,109 A 9/1996 Tingley et al.
D375,557 S 11/1996 Dixon
5,570,823 A 11/1996 Lindy
5,572,753 A 11/1996 Ruscitto
5,581,833 A 12/1996 Zenoff
5,586,351 A 12/1996 Ive
D377,423 S 1/1997 Latrella et al.
D377,881 S 2/1997 Watt
5,621,919 A 4/1997 Graham
5,647,076 A 7/1997 Gearhart
D381,790 S 8/1997 Harris et al.
D382,435 S 8/1997 Schaffner et al.
5,661,861 A 9/1997 Matthews
5,664,271 A 9/1997 Bellavance
5,685,016 A 11/1997 Douglas
5,699,569 A 12/1997 Schwarz-Zohrer
D388,589 S 1/1998 Walker
5,708,982 A 1/1998 Armani
5,778,470 A 7/1998 Haider
5,813,066 A 9/1998 Gebhard et al.
5,826,287 A 10/1998 Tandrup
5,839,138 A * 11/1998 Weidman et al. ..... 5/636
5,857,598 A 1/1999 Dunne
D408,676 S 4/1999 Straub et al.
D409,038 S 5/1999 Rojas, Jr. et al.
D412,234 S 7/1999 Cox
5,930,854 A 8/1999 O'Neill et al.
D413,751 S 9/1999 Alyea
5,946,725 A 9/1999 Shatzkin et al.
5,950,887 A 9/1999 Powell
D414,915 S 10/1999 Anderson
D416,745 S 11/1999 Noyes
5,978,990 A 11/1999 Akey
5,979,981 A 11/1999 Dunne et al.
5,987,674 A 11/1999 Schaffner et al.
D419,819 S 2/2000 Bartoli
D420,845 S 2/2000 Rumage
6,026,525 A 2/2000 Davis
6,038,720 A 3/2000 Matthews et al.
6,045,178 A * 4/2000 Miller ..... 297/129
6,049,929 A 4/2000 Rawson
6,052,848 A 4/2000 Kelly
6,055,687 A 5/2000 Matthews
6,061,854 A 5/2000 Crowley
6,065,655 A 5/2000 Parewick
6,079,067 A 6/2000 Becker et al.
6,088,854 A 7/2000 Brownrigg
6,112,960 A 9/2000 Seering et al.
6,119,873 A 9/2000 Matthews
6,123,389 A 9/2000 O'Connor et al.
D431,745 S 10/2000 Jackson
6,141,805 A 11/2000 Fisher-Cohen et al.
6,141,807 A * 11/2000 Tapper ..... 5/653
6,205,600 B1 3/2001 Sedlack
6,209,962 B1 * 4/2001 Sobel et al. ..... 297/452.17
6,212,717 B1 * 4/2001 Cooper ..... 5/653
6,213,362 B1 4/2001 Lorenzini et al.
D443,461 S 6/2001 Hall et al.
D444,981 S 7/2001 Hall et al.
D445,506 S 7/2001 Vinson et al.
D446,675 S 8/2001 Straub
6,279,185 B1 8/2001 Matthews
D447,376 S 9/2001 Kramer
D450,517 S 11/2001 Darling et al.
D453,653 S 2/2002 Tunnell
6,343,727 B1 2/2002 Leach
6,349,437 B1 2/2002 Horning
6,354,665 B1 3/2002 Ross
6,408,463 B1 6/2002 Palacio
6,412,128 B1 7/2002 Matthews
6,427,251 B1 8/2002 Leach
6,434,769 B1 8/2002 Koenig
6,434,770 B2 8/2002 Matthews Brown
6,453,493 B1 9/2002 Matthews Brown
6,457,195 B1 10/2002 Holste
6,463,608 B1 10/2002 Moe
6,484,337 B1 11/2002 Moe et al.
D467,117 S 12/2002 Guy
6,499,164 B1 12/2002 Leach
6,499,165 B1 12/2002 Morgillo
6,505,366 B1 1/2003 Lied
6,532,612 B2 3/2003 Matthews Brown
6,539,567 B1 4/2003 Bae
6,553,590 B1 4/2003 Leach
6,574,810 B2 6/2003 Mangiaracina
6,601,252 B1 8/2003 Leach
6,625,828 B2 9/2003 Matthews Brown
6,640,977 B2 11/2003 Matthews Brown et al.
6,658,681 B2 12/2003 Britto et al.
6,662,390 B1 12/2003 Berger
6,671,908 B2 1/2004 Brown et al.
6,685,024 B1 2/2004 Matthews
6,692,072 B2 2/2004 Nelson et al.
6,708,354 B1 3/2004 Carter et al.
6,711,770 B1 3/2004 Owens et al.
6,751,817 B1 6/2004 Leach
D492,533 S 7/2004 Cole
6,760,934 B1 7/2004 Leach
6,763,539 B1 7/2004 Bartley et al.
D493,964 S 8/2004 Low
6,802,092 B1 10/2004 Klein
6,814,405 B2 11/2004 Norman
6,851,143 B2 2/2005 Matthews Brown
6,857,150 B2 * 2/2005 Matthews Brown et al. .... 5/655
D503,063 S 3/2005 Bartle et al.
6,874,183 B1 4/2005 Taylor
6,892,406 B2 5/2005 Littlehorn
6,905,169 B1 * 6/2005 Donoghue ..... 297/250.1
6,920,655 B2 7/2005 Mitchell
6,944,898 B2 9/2005 Matthews Brown et al.
7,000,273 B2 2/2006 Rivera-Wienhold et al.
7,000,274 B2 2/2006 Matthews Brown et al.
7,000,275 B2 2/2006 Matthews Brown et al.
7,000,766 B2 2/2006 Matthews Brown et al.
7,010,821 B1 3/2006 Leach
7,017,212 B2 3/2006 Matthews Brown
D518,989 S 4/2006 Clapp
7,055,196 B2 6/2006 Littlehorn
7,089,639 B2 8/2006 Matthews Brown et al.
7,114,206 B2 10/2006 Leach
7,127,760 B2 10/2006 Bartley et al.
7,131,156 B1 11/2006 Walker-Craft
7,140,057 B2 * 11/2006 Hetzel et al. ..... 5/653
7,146,663 B2 12/2006 Brown et al.
2002/0029422 A1 3/2002 Matthews
2004/0060116 A1 4/2004 Matthews-Brown
2005/0210591 A1 9/2005 Mead et al.
2006/0031992 A1 2/2006 Moore
2007/0022526 A1 2/2007 Leach
2007/0028384 A1 2/2007 Leach
2007/0046084 A1 3/2007 Leach
2007/0151031 A1 7/2007 Leach

FOREIGN PATENT DOCUMENTS

WO PCT/US01/270768 A1 3/2002

* cited by examiner

NON-SLIP BODY-CONFORMING BOOSTER CUSHION SEAT

FIELD OF THE INVENTION

The present intention relates to a non-slip body-conforming booster cushion seat. More particularly, the present invention is a booster cushion seat comprising an outer portion having four sides, a substantially square bottom portion or base, and a depressed upper portion, the substantially square bottom portion or base having a textured surface to prevent slipping, and the booster cushion seat having a malleable filler material to as to permit the cushion to conform to the body shape of a user. The booster cushion seat is further provided with a safety belt to secure a juvenile user in place on the booster cushion seat.

SUMMARY OF THE INVENTION

A non-slip body-conforming booster cushion seat comprising an outer portion having four sides, each of the four sides being comprised of a substantially trapezoid shaped panel, the largest side of each trapezoid shaped panel attaching to the bottom portion or base, a substantially square bottom portion or base, and a depressed upper portion which forms the central section of the booster cushion seat, the substantially square bottom portion or base having a textured surface, preferably with a rubber or similar texture, to prevent slipping when placed against a substantially flat surface, and the booster cushion seat having a malleable filler material to as to permit the cushion to conform to the body shape of a user or, more particularly, to the buttock area of a juvenile user. The depth of the depressed central section may be adjusted by varying the degree of tightness with which the strap is pulled and secured around the chair back. When the strap is pulled tightly around a chair back, the depressed central section is raised, and when the strap is secured in a loose fashion around a chair back, the depressed central section is lowered. Thus, the strap allows the user to be positioned higher, such as for greater visibility in a theater, or lower, to permit the user seated on a dining-type chair in combination with the booster cushion seat to fit under a dining table. Additionally, the degree of tightness may be altered to accommodate the size of the user. The strap may be pulled tighter to create a smaller depressed central section to accommodate a small child user or, alternatively, the strap could be secured in a more loose fashion to accommodate a larger user. In this way, the height of the cushion may be adjusted by adjusting the tension on the strap. Once the user is seated within the depressed central section of the booster cushion seat with the booster cushion seat conformed to the body of the user, the rearmost trapezoid shaped panel may provide a support for the user's lower back. The booster cushion seat is further provided with a safety belt comprising a nylon webbing or similar type material, which safety belt is adapted to secure a juvenile user in place on the booster cushion seat. The safety belt is substantially T-shaped, including a perpendicularly extending leg and a cross member. The perpendicularly extending leg of the T has a first and second end thereon, the first end being attached to the booster cushion seat at a point midway along one of the trapezoid shaped panels. The cross member of the T has a first and second end thereon. The first end of the cross member is provided with a female receiving member of a buckle, and the second end of the cross member is provided with a male member of a buckle. The female member of the buckle is adapted to receive the male member to secure the buckle in place. The cross member of the T-shaped safety belt is of sufficient length to encompass the torso of a toddler-aged child or other juvenile user. Additionally, the cross member of the safety belt preferably is provided with a means for adjusting the length of the belt to accommodate a growing child. Alternatively, the booster cushion seat could be sized to accommodate an adult user by lengthening the adjustable safety belt.

DETAILED DESCRIPTION OF THE PREFERRED EMBODIMENTS

Figure 1:
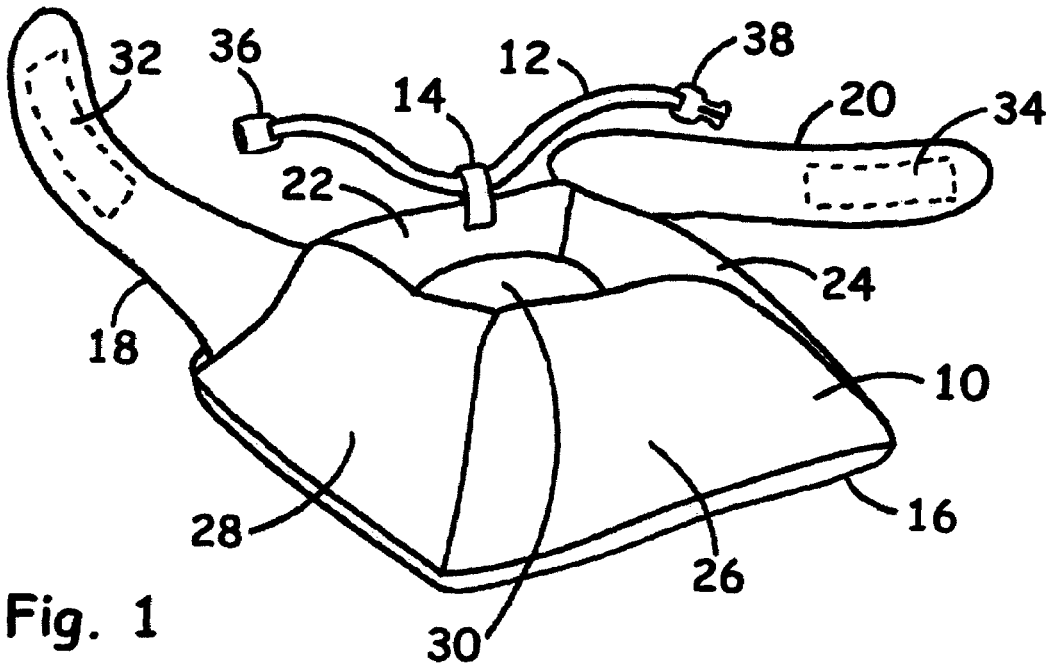
FIG. 1 is a perspective view of the non-slip body-conforming booster cushion seat of the present invention showing the adjustable tabs in an open position.

Referring to the drawings in detail, FIG. 1 shows a perspective view of a non-slip body-conforming booster cushion seat 10 comprising a substantially square base 16 having four sides thereon and which is provided with a textured surface thereon to prevent the textured base from slipping when the textured base contacts another surface, such as a chair seat (not shown in this figure). The textured base is connected by a seam (not numbered) to four fabric sides 22, 24, 26 and 28. Each of the four fabric sides 22, 24, 26 and 28 is provided with a top edge, a first side edge, a second side edge, and a top edge (not numbered), and each of the four fabric sides 22, 24, 26 and 28 is attached at the bottom edge thereof to one of the four sides of the substantially square textured base 16. Each of the fabric sides 22, 24, 26 and 28 tapers convergingly inward from the point where the side attaches to the textured base 16 to form a substantially trapezoid shape (not numbered). The first and second ends of each of the trapezoid shaped sides are joined to an adjacent side by a seam (not numbered) such that the first side edge of the fabric side 22 meets the second side edge of fabric side 28, the first side edge of fabric side 24 meets the second side edge of fabric side 22, the first side edge of fabric side 26 meets the second side edge of fabric side 24, and the first side edge of fabric side 28 meets the second side edge of fabric side 26. The top of each trapezoid shaped fabric side 22, 24, 26 and 28 is stitched to a central substantially circular portion which, when all portions are interconnected, forms a substantially pyramid-type shape with a depressed central section 30 which depressed central section 30 is adapted to receive the buttocks of a juvenile user or small adult user (not shown in this figure). Two fabric arms 18 and 20 are attached to the seam which joins fabric sides 22 and 28 and 24 and 22, respectively. The fabric arms 18 and 20 are provided with a hook and loop or other type of fastening device 32 and 34, respectively, at the ends thereof. A T-shaped safety belt comprising a horizontal leg 14 and a cross member 12, and preferably made from a webbing-type strap material, is attached at a central location along the fabric side 22. The cross member 12 may be inserted through the horizontal leg 14, sewn onto the horizontal leg 14, or otherwise connected to the horizontal leg 14. The cross member 12 of the T-shaped safety belt has a first end and a second end (not numbered). The first end of the cross member 12 is provided with a female receiving member 36 of a commercially available buckle-type device. The second end of the cross member 12 is provided with a male member 38 of a commercially available buckle-type device, such that when the male member 38 is inserted into the female receiving member 36, the cross member 12 is secured in a circular form adapted to encircle the waist or torso of the juvenile user or small adult user (not shown in this figure). The T-shaped safety belt may be alternatively provided with hook and loop, plastic or other type fasteners at each of its respective ends to secure the user adjustably on the booster cushion. The T-shaped safety belt may be provided with a means for lengthening the cross member 12 and/or the horizontal leg 14 of the T-shaped safety belt to permit customized adjustment to fit a plurality of users. The two fabric arms 18 and 20 are adapted to wrap around the back of a chair (or other seating) and connect by means of hook and loop fasteners 32 and 34, respectively, (or other means). Thus, the arms 18 and 20 form a strap for the purpose of securing the booster cushion seat 10 on to the chair (or other seating) to further prevent slippage. When the booster cushion seat 10 is placed onto a surface, such as a chair (not shown in this figure), the fabric arms 18 and 20 wrap around the chair back (not shown in this figure), overlap each other at their respective ends, and the first hook and loop (or other type) fastener 32 contacts the second hook and loop (or other type) fastener 34 to secure the fabric arms 18 and 20 in place. The substantially square textured base 16 of the booster cushion seat 10 comprises a non-slip or textured surface (as indicated above) to prevent the booster cushion seat 10 from moving when placed in contact with a polished or "slick" surface such as a wooden chair, vinyl upholstered seat, or the like. The booster cushion seat 10 is filled with polystyrene beads or similar filling to create the feel and malleability of a bean bag. This filling permits the booster cushion to conform to the shape of the user, allowing the buttocks of the user to sink into the seat for greater stability and comfort. The booster cushion seat 10 is adapted for use by a juvenile user or a small adult and may be employed in a plurality of uses where a user desires to be elevated to a higher position, such as at the dinner table, in a restaurant booth/chair, or in a theater setting.

Figure 2:
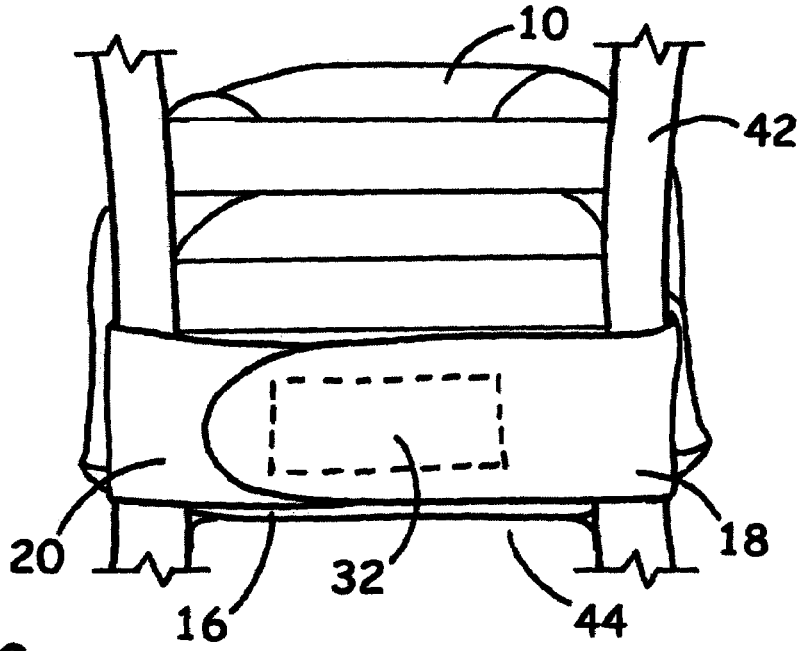
FIG. 2 is a rear view of the non-slip body-conforming booster cushion seat of the present invention showing the adjustable tabs in a closed position around the back of a chair.

FIG. 2 shows a non-slip body-conforming booster cushion seat 10 having the strap formed by the two fabric arms 18 and 20 wrapped around the back of a chair 42 and connected by means of the hook and loop fasteners 32 and 34, respectively, for the purpose of securing the booster cushion seat on to the chair. The booster cushion seat 10 is received on top of the chair seat 44 such that the textured base 16 of the booster cushion seat 10 contacts the chair seat 44. The textured base 16 is adapted to prevent the booster cushion seat 10 from slipping when placed into contact with the chair seat 44 as indicated above. The fabric arms 18 and 20 wrap around the chair back 42, overlap each other at their respective ends, and the first hook and loop fastener 32 contacts the second hook and loop fastener 34 to secure the fabric arms 18 and 20 in place around the chair back 42. The depressed central section 30 (not shown in this figure) may be slightly elevated by tightening the strap, that is, by wrapping the fabric arms 18 and 20 in tight fashion and securing them in the tight position by means of the hook and loop fasteners 32 and 34, respectively, to accommodate a smaller user. Conversely, the depressed central section 30 (not shown in this figure) may be further depressed by loosening the strap, that is, wrapping the fabric arms 18 and 20 in loose fashion and securing them in the loose position by means of the hook and loop fasteners 32 and 34, respectively, to accommodate a larger user. Thus, the height of the cushion may be adjusted by adjusting the tension on the strap.

Figure 3:
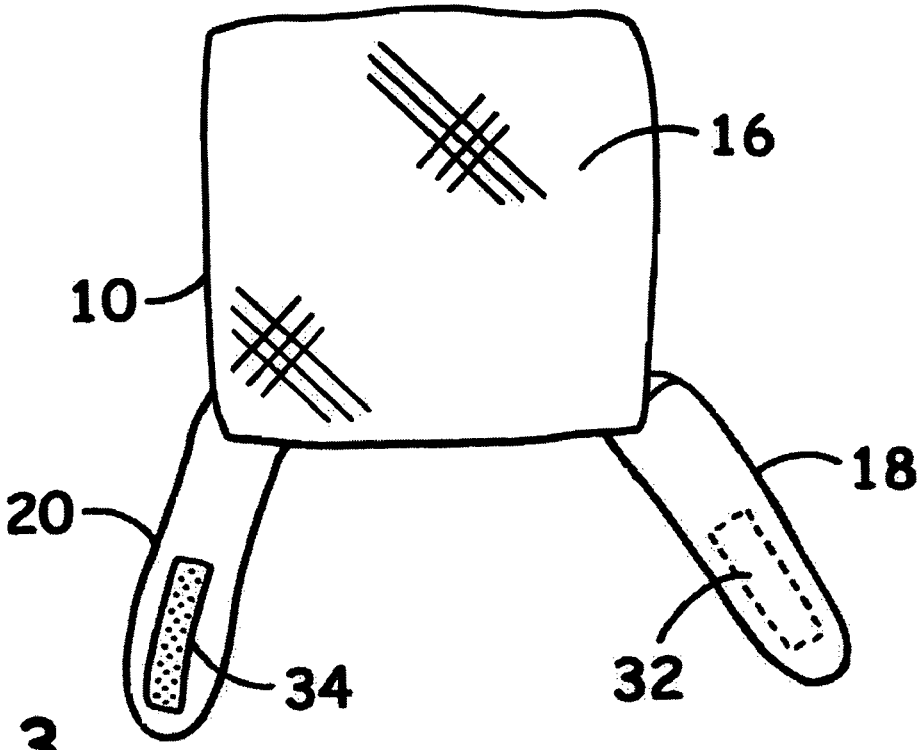
FIG. 3 is a bottom view of the non-slip body-conforming booster cushion seat of the present invention showing the non-slip textured base and showing the adjustable tabs in an open position.

FIG. 3 shows a bottom view of the non-slip body-conforming booster cushion seat 10 having a substantially square shaped textured base 16, as indicated above. A first fabric arm 18 is provided with a first hook and loop type fastener 32, and a second fabric arm 20 is provided with a second hook and loop type fastener 34. In this figure, the first and second fabric arms 18 and 20, respectively, are in an unattached or loose position.

Figure 4:
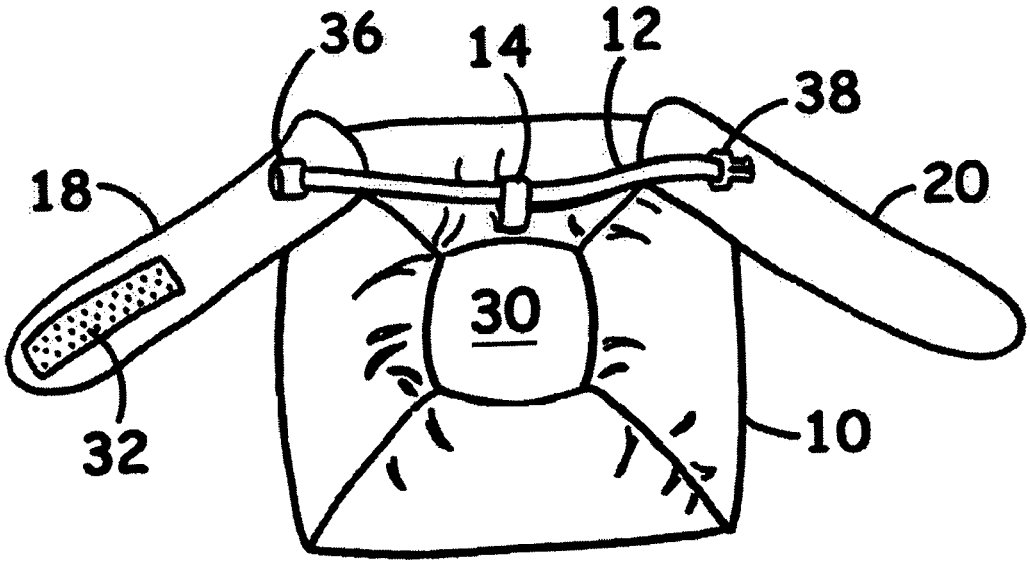
FIG. 4 is a top view of the non-slip body-conforming booster cushion seat of the present invention showing the adjustable tabs in an open position and the T-shaped belt in an open position.

FIG. 4 shows a top view of the non-slip body-conforming booster cushion seat 10 wherein the first and second fabric arms 18 and 20, respectively, are in the unattached or loose position. A T-shaped safety belt comprising a horizontal leg 14 and a cross member 12 is shown in an open, extended position. The first end of the cross member 12 of the T-shaped safety belt is provided with a male member 38 of a commercially available type buckle. The second end of the cross member 12 of the T-shaped safety belt is provided with a female receiving member 36 adapted to receive the male member 38 to form a continuous loop around the waist or torso of a user (not shown in this figure).

Figure 5:
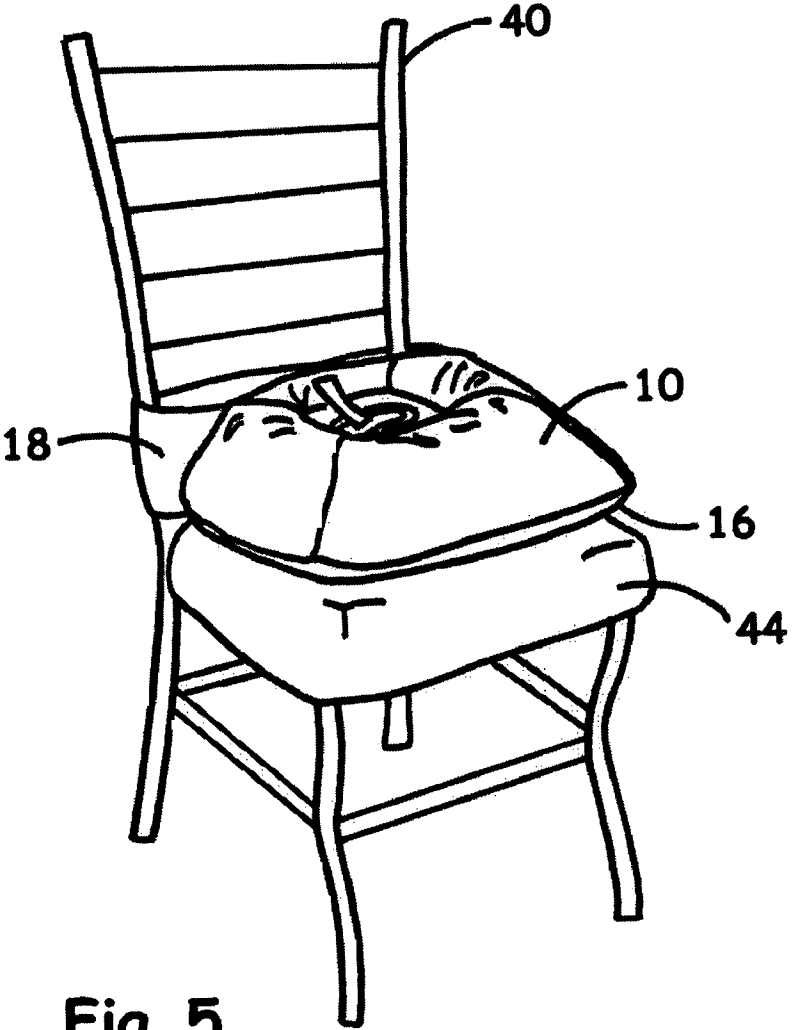
FIG. 5 is a perspective view of the non-slip body-conforming booster cushion seat of the present invention showing the booster cushion seat in position on a dining-type chair when viewing the chair from the front.

FIG. 5 shows a perspective view taken from the front of a non-slip body-conforming booster cushion seat 10 placed on a dining-type chair 40. The substantially square textured base 16 is in contact with the chair seat 44. The fabric arms 18 and 20 (number 20 not shown in this figure) are engaged by means of their hook and loop type fasteners 32 and 34, respectively (not shown in this figure), so that the fabric arms 18 and 20 form a strap encircling the chair back to secure the booster cushion seat 10 in place.

Figure 6:
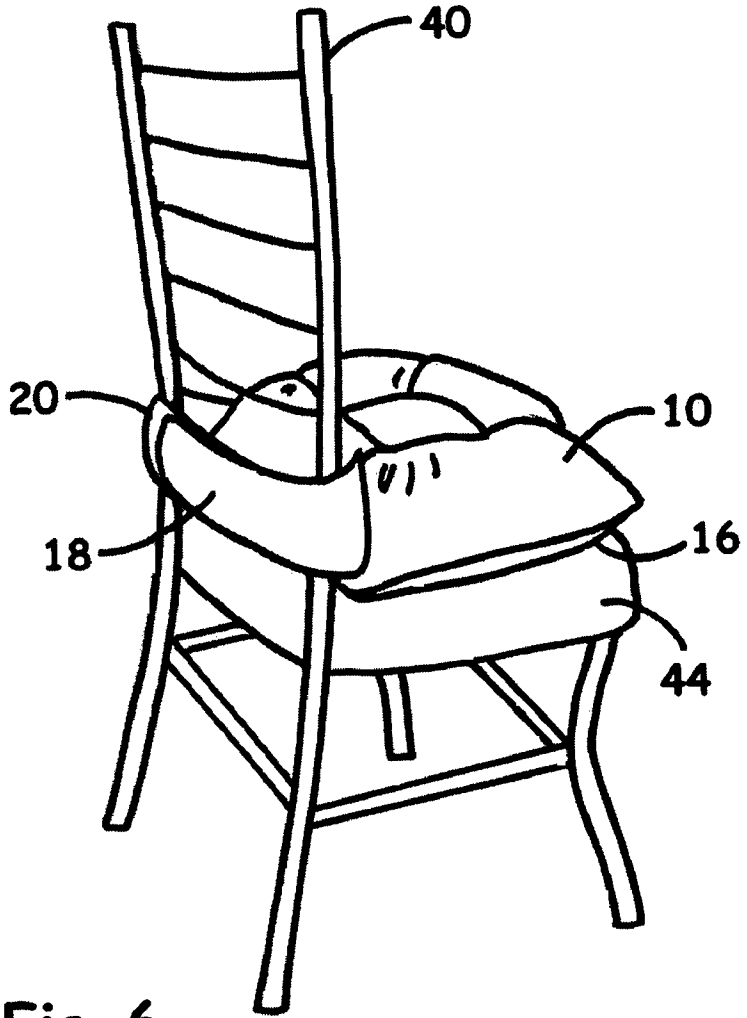
FIG. 6 is a perspective view of the non-slip body-conforming booster cushion seat of the present invention showing the booster cushion seat in position on a dining-type chair when viewing the chair from the rear.

FIG. 6 shows a perspective view taken from the rear of a non-slip body-conforming booster cushion seat 10 placed on a dining-type chair 40, the substantially square textured base 16 being in contact with the chair seat 44. The fabric arms 18 and 20 are engaged by means of their hook and loop type fasteners 32 and 34, respectively (not shown in this figure), the fabric arms 18 and 20 forming a strap encircling the chair back to secure the booster cushion seat 10 in place.

Figure 7:
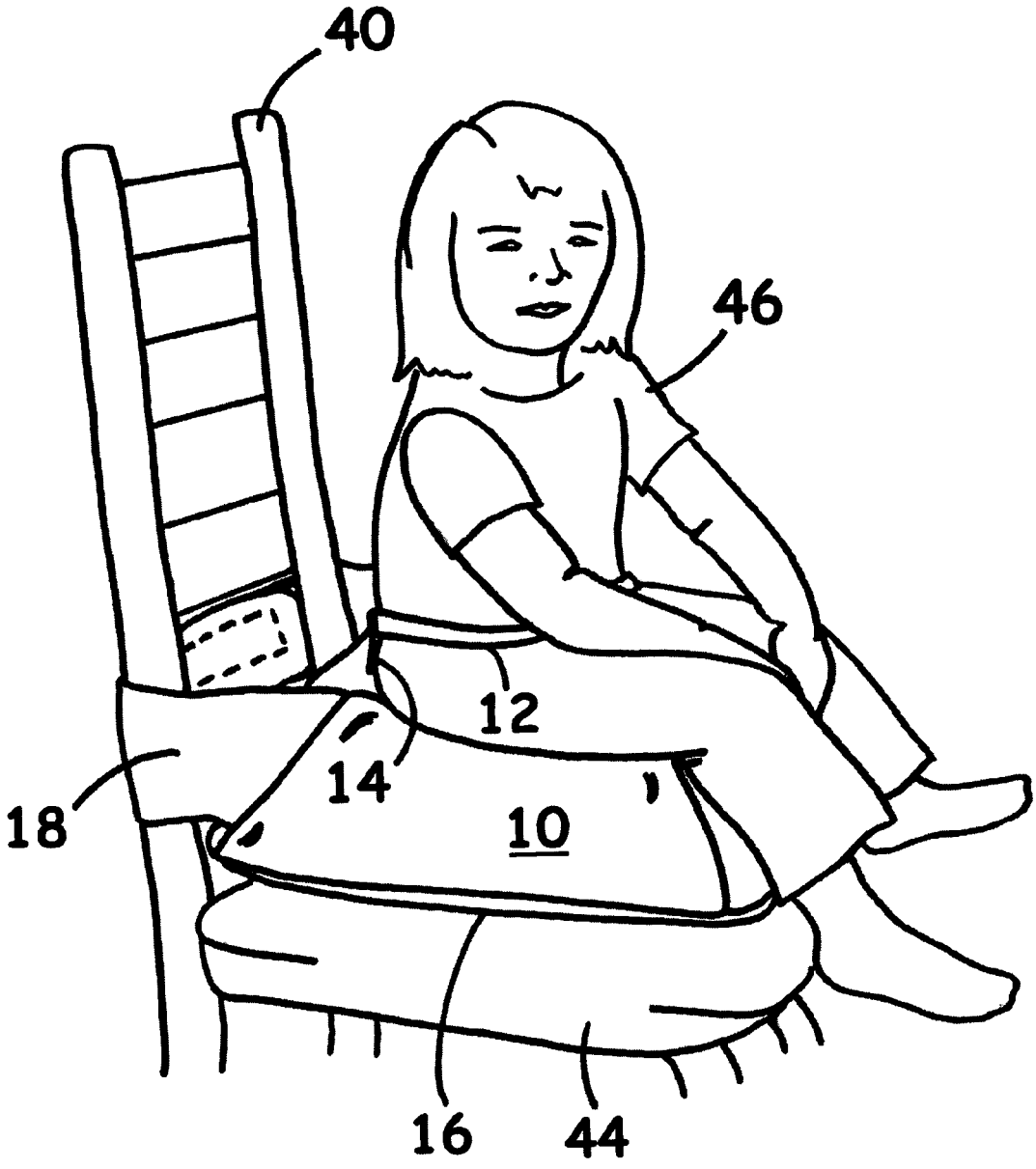
FIG. 7 is a perspective view showing a rear view of the non-slip body-conforming booster cushion seat of the present invention showing a juvenile user positioned on the booster cushion seat with the T-shaped safety belt being disposed around the torso of the juvenile user.

FIG. 7 shows a perspective view taken from the front of a non-slip body-conforming booster cushion seat 10 placed on a dining-type chair 40 with a juvenile user 46 seated atop the depressed central section 30. The substantially square textured base 16 contacts the chair seat 44. The fabric arms 18 and 20 are engaged by means of their hook and loop type fasteners 32 and 34, respectively (not shown in this figure), the fabric arms 18 and 20 forming a strap encircling the chair back to secure the booster cushion seat 10 in place. The juvenile user or small adult user is seated atop the booster cushion seat 10 with her buttocks being received in the depressed central section 30 and her legs extending from the depressed central section 30 over the third (or front) fabric side 26 (not numbered in this figure). The horizontal leg 14 of the T-shaped safety belt extends upwardly form its origin on the fabric side 22 until the cross member 12 is brought to a point substantially level to the torso or waist of the user. The first and second ends of the cross member 12 are brought about the waist of the user to encircle the waist of the user and the male member 38 is inserted into the female receiving member 36 to secure the T-shaped safety belt in place. The booster cushion seat 10 is filled with polystyrene beads or alternate filler material such that the booster cushion seat 10 comprises a malleable shape which malleable shape is adapted to conform to the body of a user 46 when the user 46 is seated on the booster cushion seat 10 to provide maximum comfort, security, and stability to the user 46.

While FIGS. 1 through 7, inclusive, depict the various positions which may be achieved with the non-slip body-conforming booster cushion seat 10 of the present invention, it should be apparent that other and further modifications of the present invention, apart from those shown or suggested herein, may be made within the spirit and scope of this invention.

What is claimed is:

1. A booster seat to support a user in an adult-sized chair, the chair having a generally horizontal seat and a generally vertical back, the booster seat comprising:

a cushion comprising a flexible enclosure and a filler material contained in the enclosure so that the cushion is malleable, wherein the cushion has a height and comprises a top, a bottom, and a side wall extending therebetween, the cushion also having a front and a rear, wherein the top of the cushion is characterized by a malleable, depressed central section having a depth and being sized to receive the buttocks of the user, and wherein the cushion is sized and shaped to be received in the seat of the chair, the overall size of the cushion being such that it does not substantially overhang the seat of the chair;

a strap extending from the side wall of the cushion and sized and positioned to adjustably secure the cushion to the back of the chair, wherein the strap is extendable a distance beyond the side wall of the cushion, the strap being configured so that the cushion can be secured to the chair without changing the height of the cushion and so that adjusting the tension on the strap changes the height of the cushion by changing the depth of the depressed central section.

2. The booster seat of claim 1 wherein the bottom of the cushion has a textured surface to prevent slipping when placed in the seat of the chair.

3. The booster seat of claim 1 wherein the top of the cushion comprises a top panel and the depressed central section is formed in the top panel.

4. The booster seat of claim 1 wherein the side wall comprises four side panels, each being comprised of a substantially trapezoid shaped fabric panel, wherein the bottom of the cushion comprises a substantially square bottom panel, wherein the top panel is generally round, wherein the largest side of each trapezoid shaped side panel attaches to the substantially square bottom panel, wherein the smaller side of each trapezoid shaped side panel attaches to the top panel, so that the cushion is generally square in horizontal section and generally frusto-conical in vertical section.

5. The booster seat of claim 1 wherein the strap comprises two fabric arms each having a first end attached to the cushion and a free end, and wherein the free ends are adjustably connectable to each other.

6. The booster seat of claim 5 wherein the first ends of the two fabric arms are attached to the side wall of the cushion in spaced apart positions on or near the rear of the cushion so that the arms can encircle the entire back of the chair.

7. The booster seat of claim 6 wherein the free ends of the two fabric arms are long enough to overlap each other and are provided with mating halves of hook-and-loop fastener material so that the tension on the strap can be increased and decreased by increasing or decreasing the overlapping area of the free ends of the fabric arms.

8. The booster seat of claim 1 wherein adjusting the tension on the strap also adjusts the depth of the depressed central section of the top of the cushion.

9. The booster seat of claim 1 further comprising a safety belt adapted to secure the user in the cushion.

10. The booster seat of claim 9 wherein the safety belt is a T-shaped belt, the safety belt having a cross member and a leg extending perpendicularly thereto, the leg of the T-shaped belt having a first and second end, the first end being attached to the booster cushion, the cross member of the T-shaped belt having a first and second end connectable to each other.

11. The booster seat of claim 10 wherein the first and second ends of the cross member are adjustably connectable to accommodate different size users.

12. The booster seat of claim 1 wherein the strap is sized to completely encircle the back of the chair.

13. The booster seat of claim 1 characterized as being free of rigid structural members that extend above the cushion.

14. A seating assembly for a user, the assembly comprising:

an adult-sized chair comprising a generally horizontal seat and a generally vertical back, the seat having a peripheral edge;

a booster seat receivable in the seat of the chair, the booster seat sized so that it does not substantially overhang the peripheral edge of the seat of the chair, and wherein the booster seat comprises:

a cushion comprising an flexible enclosure and a filler material contained in the enclosure so that the cushion is malleable, wherein the cushion has a height and comprises a top, a bottom, and a side wall extending therebetween, the cushion also having a front and a rear, wherein the top of the cushion is characterized by a malleable, depressed central section having a depth and being sized to receive the buttocks of the user;

at least one strap extending from the sidewall of the cushion and sized and positioned to adjustably secure the cushion to the back of the chair, wherein the strap is extendable a distance beyond the side wall of the cushion, the strap being configured so that the cushion can be secured to the chair without changing the height of the cushion and so that adjusting the tension on the strap changes the height of the cushion by changing the depth of the depressed central section.

15. The seating assembly of claim 14 wherein the bottom of the cushion has a textured surface to prevent slipping when placed in the seat of the chair.

16. The seating assembly of claim 14 wherein the top of the booster seat cushion comprises a top panel.

17. The seating assembly of claim 16 wherein the side wall of the booster seat cushion comprises four side panels, each being comprised of a substantially trapezoid shaped fabric panel, wherein the bottom of the cushion comprises a substantially square bottom panel, wherein the top panel is generally round, wherein the largest side of each trapezoid shaped side panel attaches to the substantially square bottom panel, wherein the smaller side of each trapezoid shaped side panel attaches to the top panel, so that the cushion is generally square in horizontal section and generally frusto-conical in vertical section.

18. The seating assembly of claim 16 wherein adjusting the tension on the strap of the booster seat cushion also adjusts the depth of the depressed central section of the top of the cushion.

19. The seating assembly of claim 14 wherein the strap of the booster seat cushion comprises two fabric arms each having a first end attached to the cushion and a free end, and wherein the free ends are adjustably connectable to each other.

20. The seating assembly of claim 19 wherein the first ends of the two fabric arms of the booster seat cushion are attached to the side wall of the cushion in spaced apart positions on or near the rear of the cushion so that the arms can encircle the entire back of the chair.

21. The seating assembly of claim 20 wherein the free ends of the two fabric arms are long enough to overlap each other and are provided with mating halves of hook-and-loop fastener material so that the tension on the strap can be increased and decreased by increasing or decreasing the overlapping area of the free ends of the fabric arms.

22. The seating assembly of claim 14 wherein the booster seat further comprises a safety belt adapted to secure the user in the cushion.

23. The seating assembly of claim 22 wherein the safety belt is a T-shaped belt, the safety belt having a cross member and a leg extending perpendicularly thereto, the leg of the T-shaped belt having a first and second end, the first end being attached to the booster cushion, the cross member of the T-shaped belt having a first and second end connectable to each other.

24. The seating assembly of claim 23 wherein the first and second ends of the cross member are adjustably connectable to accommodate different size users.

25. The seating assembly of claim 14 wherein the booster seat is characterized as being free of rigid structural members that extend above the cushion.

* * * * *